US010578400B2

(12) United States Patent
Cheng et al.

(10) Patent No.: US 10,578,400 B2
(45) Date of Patent: Mar. 3, 2020

(54) SIGHT

(71) Applicants: Sintai Optical (Shenzhen) Co., Ltd., ShenZhen, Guandong Province (CN); Asia Optical Co., Inc., Taichung (TW)

(72) Inventors: Sung-Po Cheng, Taichung (TW); Chin-Teng Lin, Taichung (TW); Chia-Kan Chang, Taichung (TW); Shang-Yung Liang, Taichung (TW)

(73) Assignees: SINTAI OPTICAL (SHENZHEN) CO., LTD., Shenzhen, Guandong Province (CN); ASIA OPTICAL CO., INC., Taichung (TW)

( * ) Notice: Subject to any disclaimer, the term of this patent is extended or adjusted under 35 U.S.C. 154(b) by 0 days.

(21) Appl. No.: 16/200,738

(22) Filed: Nov. 27, 2018

(65) Prior Publication Data

US 2019/0195597 A1 Jun. 27, 2019

(30) Foreign Application Priority Data

Dec. 27, 2017 (CN) ..... 2017 1 1444236

(51) Int. Cl.
*F41G 1/34* (2006.01)
*F41G 1/38* (2006.01)

(52) U.S. Cl.
CPC ..... *F41G 1/345* (2013.01); *F41G 1/38* (2013.01)

(58) Field of Classification Search
CPC ..... F41G 1/345; F41G 1/38; F41G 1/387
See application file for complete search history.

(56) References Cited

U.S. PATENT DOCUMENTS 10,151,561 B1 * 12/2018 Bartak ..... F41G 1/44
2012/0000979 A1 * 1/2012 Horvath ..... F41G 1/38 235/407
2018/0010887 A1 * 1/2018 VanBecelaere ..... G02B 7/004

* cited by examiner

*Primary Examiner* — Stephen Johnson
(74) *Attorney, Agent, or Firm* — McClure, Qualey & Rodack, LLP

(57) ABSTRACT

A sight includes a main body, an objective unit, an eyepiece unit, an inner lens barrel, an adjusting ring and an indicating structure. The main body has a first end portion and a second end portion. The objective unit is connected to the first end portion. The eyepiece unit is connected to the second end portion. The inner lens barrel is disposed in the main body, wherein the objective unit, the inner lens barrel and the eyepiece unit are sequentially arranged to form an optical axis. The adjusting ring is rotatably disposed on the main body. The indicating structure is disposed on the adjusting ring and includes an illuminating element and an optical transmitting element. When the sight is connected to an electronic device, the illuminating element emits a light beam, and the light beam passes through the optical transmitting element for generating an indicating sign.

20 Claims, 7 Drawing Sheets

SIGHT

BACKGROUND OF THE INVENTION

Field of the Invention

The invention relates to a sight, and more particularly to a sight capable of indicating connection status thereof.

Description of the Related Art

When connecting a conventional sight to an electronic device, the user is unable to confirm if the connection is successful by observation. It is inconvenient for the user.

BRIEF SUMMARY OF THE INVENTION

The invention provides a sight including a magnification adjusting ring on which an indicating structure is disposed, and the indicating structure is capable of indicating connection status of the sight and an electronic device and marking present magnification of the sight.

A sight in accordance with an embodiment of the invention includes a main body, an objective unit, an eyepiece unit, an inner lens barrel, an adjusting ring and an indicating structure. The main body has a first end portion and a second end portion. The objective unit is connected to the first end portion. The eyepiece unit is connected to the second end portion. The inner lens barrel is disposed in the main body and between the objective unit and the eyepiece unit and includes a plurality of lenses, wherein the objective unit, the inner lens barrel and the eyepiece unit are sequentially arranged to form an optical axis. The adjusting ring is rotatably disposed on the main body. The indicating structure is disposed on the adjusting ring and includes an illuminating element and an optical transmitting element. When the sight is connected to an electronic device, the illuminating element emits a light beam, and the light beam passes through the optical transmitting element for generating an indicating sign.

In another embodiment, the main body further has two conductive elements, the illuminating element has two pins, and the conductive elements are respectively connected to the pins of the illuminating element.

In yet another embodiment, the adjusting ring covers the conductive elements.

In another embodiment, the indicating structure further includes a circuit board and two leg members, the illuminating element and the leg members are disposed on the circuit board so that the leg members are respectively connected to the pins of the illuminating element.

In yet another embodiment, the leg members respectively extend from the circuit board, through the adjusting ring and against the conductive elements.

In another embodiment, the sight further includes a power supply disposed in the main body and configured to provide electric current for the illuminating element through the conductive elements, the leg members and the circuit board so that the illuminating element emits the light beam.

In yet another embodiment, the sight further includes a control unit and an aiming symbol. The control unit is disposed in the main body, wherein when the sight is connected to the electronic device, the control unit is configured to control the electric current to flow through the illuminating element. The aiming symbol is disposed between the objective unit and the inner lens barrel or disposed between the inner lens barrel and the eyepiece unit, In another embodiment, the conductive elements are curved to substantially extend in a circumferential direction of the main body.

In yet another embodiment, the sight further includes a communication unit disposed in the main body, wherein the sight is wirelessly connected to the electronic device through the communication unit.

In another embodiment, the optical transmitting element has a receiving end, and the receiving end is configured to receive the light beam and includes a plane sloping at an angle with respect to the optical axis.

In yet another embodiment, the angle is substantially 45 degrees.

In another embodiment, the optical transmitting element has a receiving end, and the receiving end includes a light penetrable area configured to receive the light beam.

A sight in accordance with another embodiment of the invention includes a main body, an objective unit, an eyepiece unit, an adjusting ring and an indicating structure. The main body has a first end portion and a second end portion. The objective unit is connected to the first end portion. The eyepiece unit is connected to the second end portion. The adjusting ring is rotatably disposed on the main body. The indicating structure is disposed on the adjusting ring and includes a bi-color illuminating element and an optical transmitting element. When the sight is connected to an electronic device, the illuminating element emits a first light beam, and the first light beam passes through the optical transmitting element for generating a first indicating sign. When the sight is not connected to the electronic device, the illuminating element emits a second light beam, and the second light beam passes through the optical transmitting element for generating a second indicating signal.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
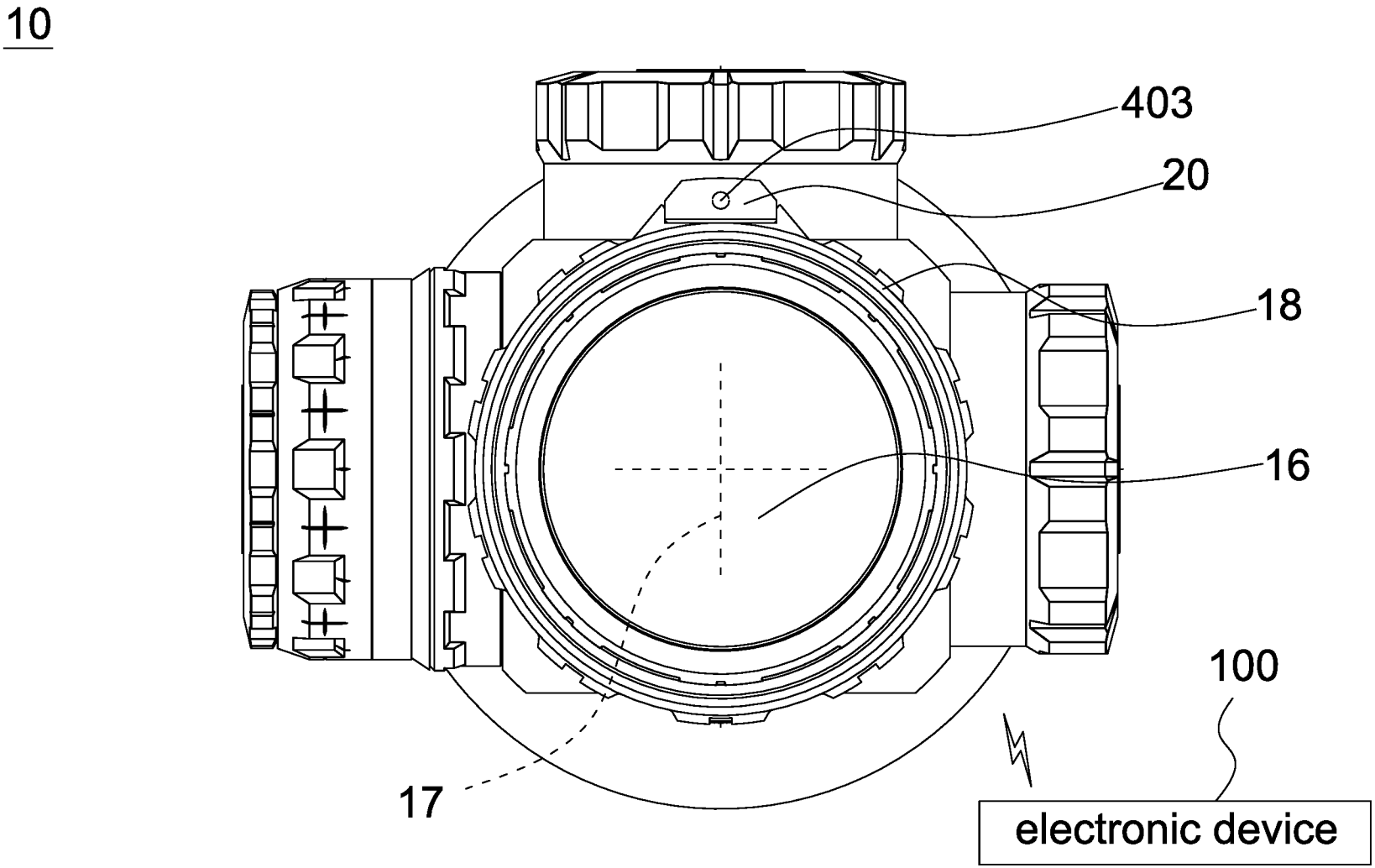
FIG. 1 is a rear view of a sight in accordance with an embodiment of the invention.

Referring to FIG. 1, FIG. 1 depicts a sight 10 in accordance with an embodiment of the invention. Before operating the sight 10 to correct bullet impact points, measurements (e.g. distance or wind speed measurement) and calculations (e.g. calculating amount of correction according to distance or wind speed information) should be performed for providing amount of correction for a user. The sight 10 can be wirelessly connected to an electronic device 100 of the user for transmitting information therebetween and performing above described measurements and calculations. In one embodiment, the user performs measurements by the sight 10 and performs calculations by the electronic device 100 (e.g. mobile phone or computer). In another embodiment, the user performs calculations by the sight 10 and performs measurements by the electronic device 100 (e.g. rangefinder or anemometer). In yet another embodiment, the user performs both calculations and measurements by the electronic device 100 (e.g. mobile phone or computer capable of measurement).

During operation, the user comes close to an eyepiece unit 16 of the sight 10 for observing an object. Meanwhile, an indicating structure 20 indicates the present connection status of the sight 10 (e.g. connected or disconnected to the electronic device 100) to the user. Moreover, the user can rotate an adjusting ring 18 to adjust magnification of the sight 10 and to move the indicating structure 20. Therefore, the indicating structure 20 can also indicate present magnification to the user.

Referring to FIGS. 1 and 2, 2A, 2B and 2C, the sight 10 includes a main body 12, an inner lens barrel 13, an objective unit 14, the eyepiece unit 16, an aiming symbol 17, at least one adjusting knob (not shown), the adjusting ring 18, the indicating structure 20, two conductive elements 22, a communication unit 23, a power supply 19 and a control unit 21.

Figure 2A:
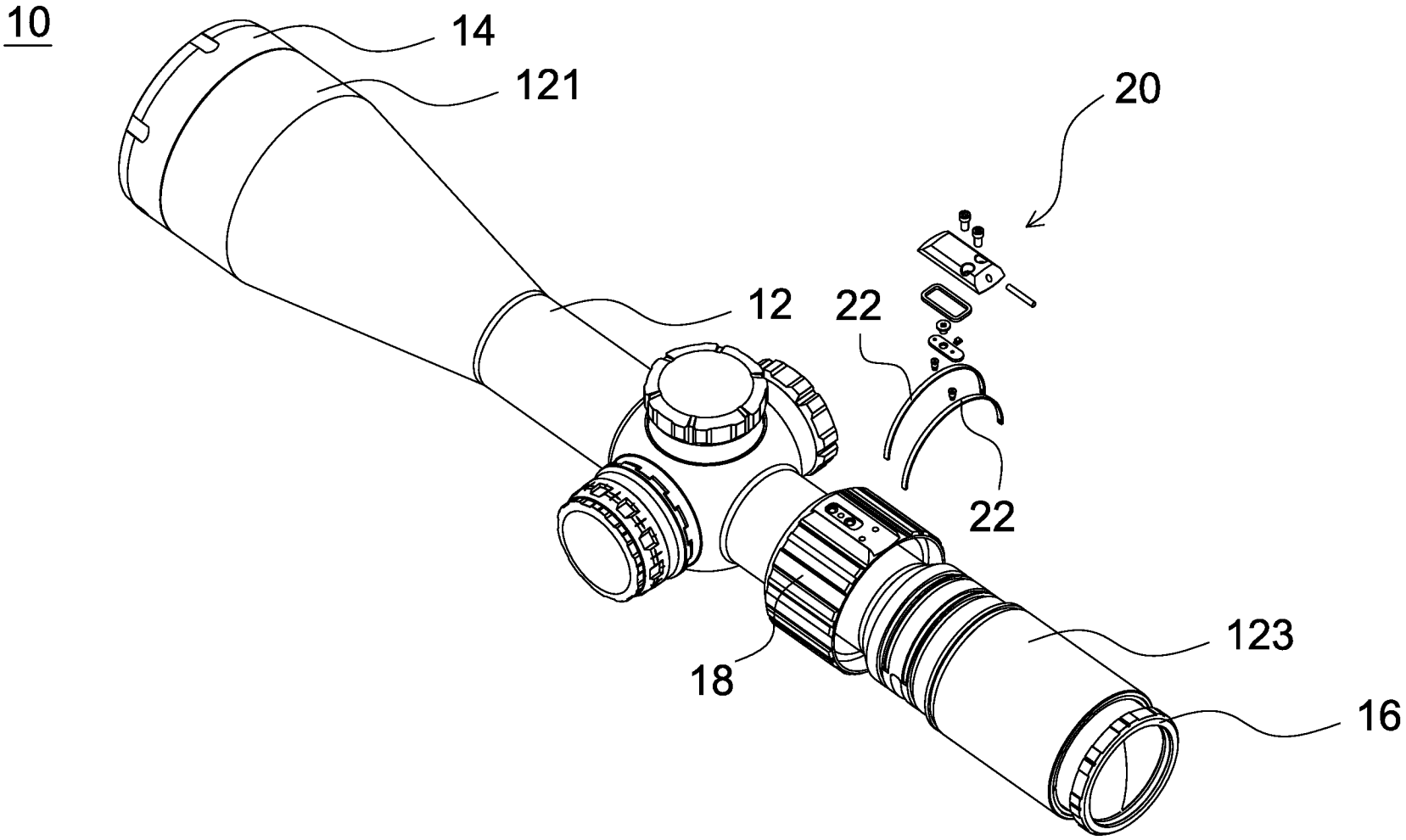
FIGS. 2A, 2B and 2C are respectively a schematic view of the sight of FIG. 1, a schematic view of the inner lens barrel disposed in the main body of the sight, and a block diagram of the communication unit, the power supply and the control unit disposed in the main body of the sight.
Figure 2B:
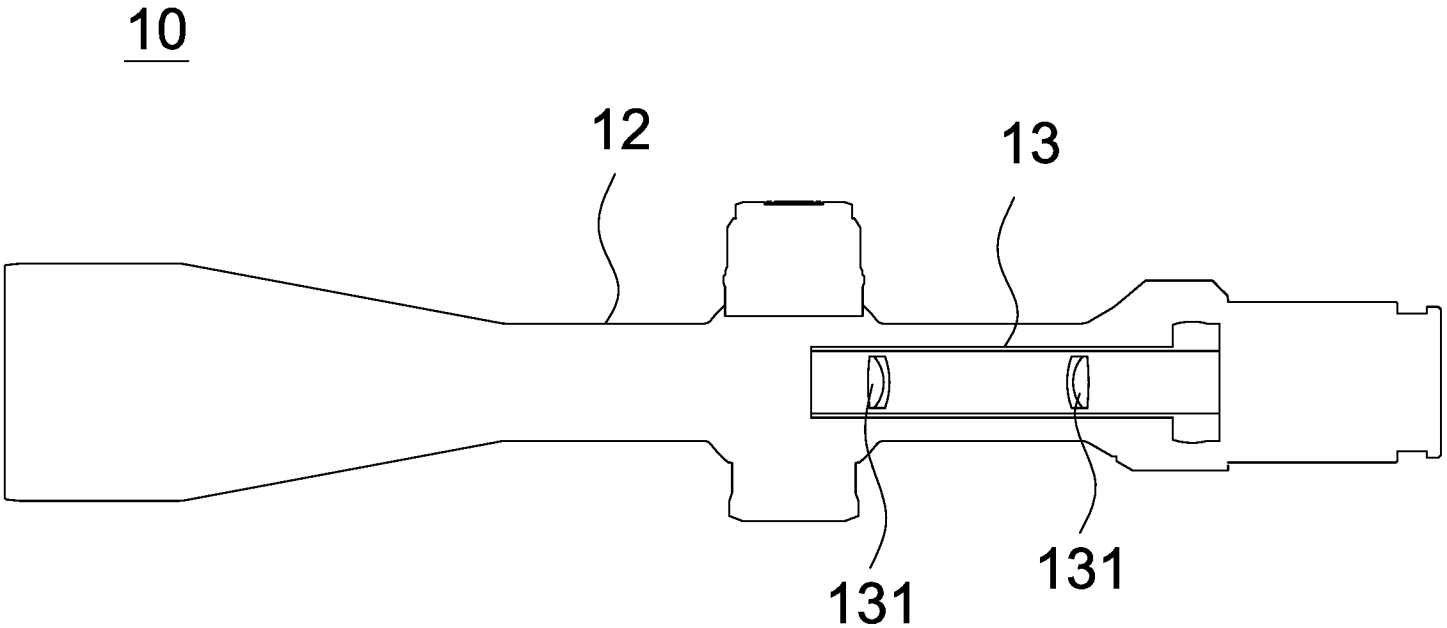

As shown in FIGS. 2A and 2B, the main body 12 has a front-end portion 121 and a rear end portion 123, the objective unit 14 is connected to the front-end portion 121, and the eyepiece unit 16 is connected to the rear end portion 123. The inner lens barrel 13 is disposed in the main body 12 and between the objective unit 14 and the eyepiece unit 16 and includes a plurality of lenses 131. The objective unit 14, the inner lens barrel 13 and the eyepiece unit 16 are sequentially arranged to form an optical axis (not shown). The aiming symbol 17 is disposed between the objective unit 14 and the inner lens barrel 13 or disposed between the inner lens barrel 13 and the eyepiece unit 16. The adjusting knob is disposed on the main body 12, is placed against outer circumferential surfaces of the inner lens barrel 13 and is configured to move the inner lens barrel 13 for adjusting the optical axis with respect to a central axis of the main body 12.

Figure 3A:
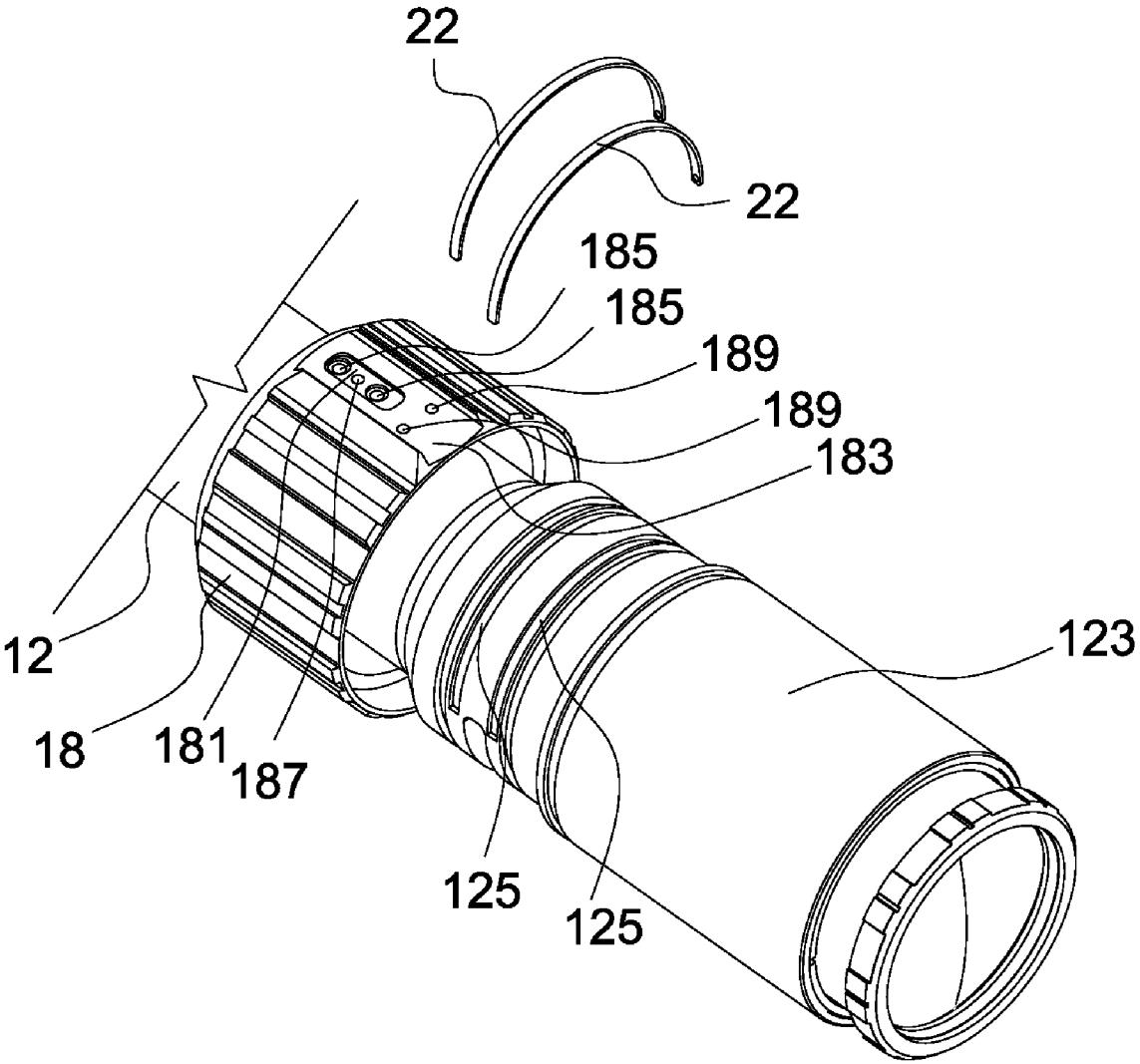
FIG. 3A is a schematic view of a main body, an adjusting ring and two conductive elements of FIG. 2A.

Referring to FIG. 3A, the main body 12 has two grooves 125, and the conductive elements 22 are respectively disposed in the grooves 125. Each of the conductive elements 22 is a copper strip which is curved and substantially extended in a circumferential direction of the main body 12. A central angle corresponding to the copper strip ranges from 140 to 160 degrees. The adjusting ring 18 is rotatably disposed on the main body 12, covers the conductive elements 22 and has a first receiving portion 183. The first receiving portion 183 has two second fixing holes 189 and a second receiving portion 181. The second receiving portion 181 has two first through holes 185 and a first fixing hole 187. In present embodiment, each of the conductive elements 22 is an element capable of conducting electricity (or named electric conductor) and includes metal (e.g. gold, silver, copper, iron but not limited thereto) or non-metal (e.g. graphite).

Figure 3B:
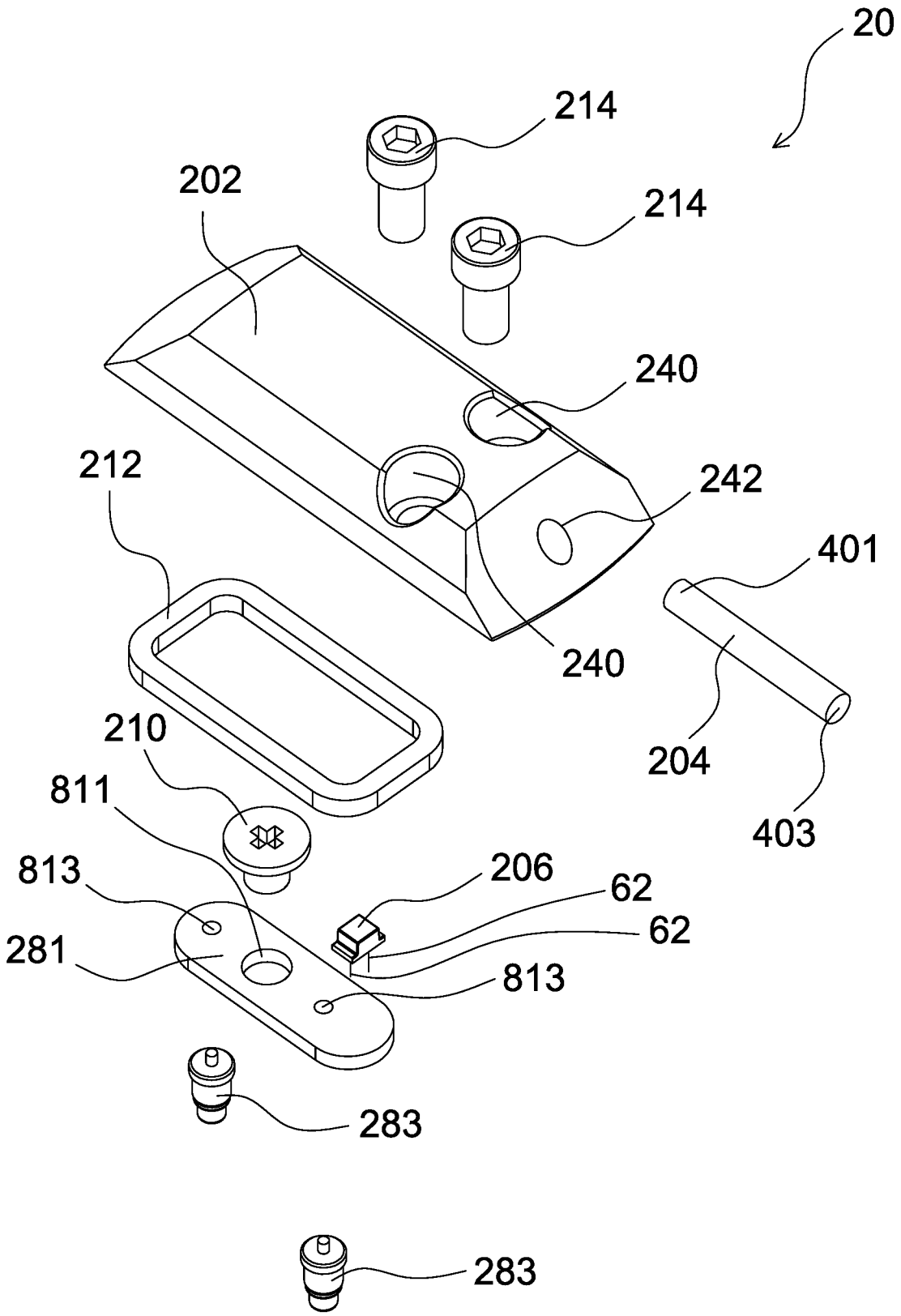
FIG. 3B is a schematic view of an indicating structure of FIG. 2A.
Figure 4:
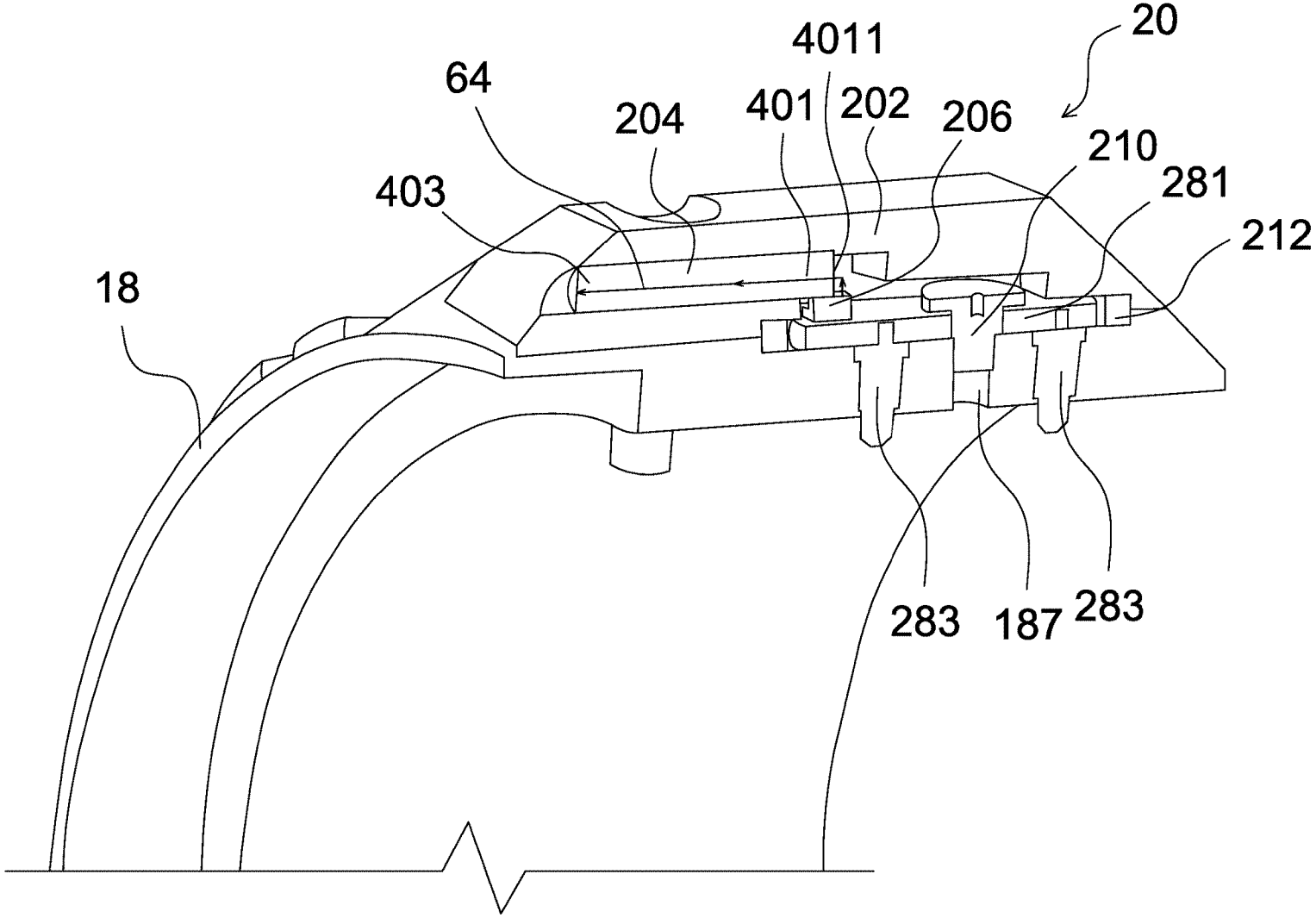
FIG. 4 is a sectional view of the adjusting ring and the indicating structure of FIG. 1.

Referring to FIG. 3B, the indicating structure 20 includes a cover 202, an optical transmitting element 204, an illuminating element 206, a circuit board 281, two leg members 283, a first fixing element 210, a gasket 212 and two second fixing elements 214. The circuit board 281 has a second through hole 811 and two conductive holes 813. During assembly of the indicating structure 20, the first fixing element 210 is penetrated through the second through hole 811 and is disposed in the first fixing hole 187 for fixing the circuit board 281 to the second receiving portion 181. Each of the leg members 283 has a first end and a second end (that is, there are two first ends and two second ends in present embodiment), the first ends are fixed in the conductive holes 813, and the second ends are penetrated through the first through holes 185 and against the conductive elements 22. The illuminating element 206 is disposed on the circuit board 281 and has two pins 62, and the pins 62 are connected to the leg members 283 through conducting wires (not shown) of the circuit board 281. The gasket 212 surrounds the circuit board 281 and is disposed in the second receiving portion 181. The cover 202 has two third through holes 240 and a third receiving portion 242. The second fixing elements 214 are respectively penetrated through the third through holes 240 and are disposed in the second fixing holes 189 for fixing the cover 202 to the first receiving portion 183. The optical transmitting element 204 is disposed in the third receiving portion 242 and has a receiving end 401 and an emitting end 403. Referring to FIG. 4, when the optical transmitting element 204 is disposed in the third receiving portion 242, the receiving end 401 is adjacent to or is placed against the illuminating element 206, and the emitting end 403 is observable from the outside of the sight 10.

Figure 2C:
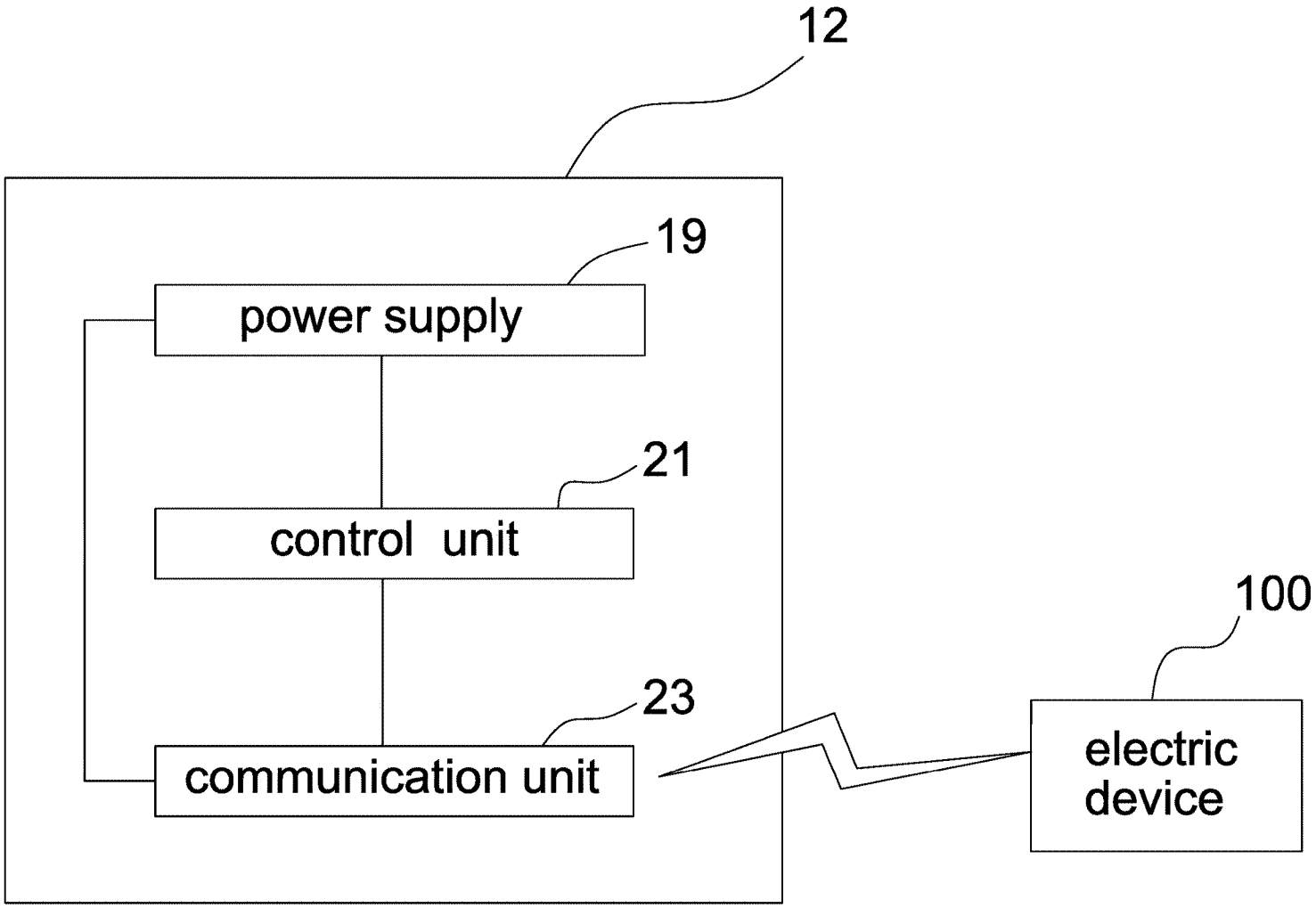

The communication unit 23, the power supply 19 and the control unit 21 are disposed in the main body 12 as shown in FIG. 2C. The communication unit 23 is wirelessly connected to the electronic device 100 of the user for receiving or transmitting information to the electronic device 100. The power supply 19 is configured to provide electric power for all electronic elements of the sight 10. It is worth noting that the illuminating element 206, the circuit board 281, the leg members 283, the conductive elements 22, the control unit 21 and the power supply 19 constitute a conducting loop. The control unit 21 is configured to switch the conducting loop to a conducting state (or cut-off state) for controlling electric current generated by the power supply 19 to flow (or not to flow) through the illuminating element 206 so as to control the illuminating element 206 to emit light (or not to emit light). In present embodiment, the communication unit 23 includes a Bluetooth module, the power supply 19 includes a battery, and the control unit 21 includes a switch and a processor.

As shown in FIG. 1, the user can observe the indicating structure 20 in a direction parallel to the optical axis after operating the sight 10 to connect to the electronic device 100. When the sight 10 is successfully connected to the electronic device 100 through the communication unit 23, the control unit 21 is activated to switch the conducting loop to the conducting state. Meanwhile, the electric current flows through the illuminating element 206 so that the illuminating element 206 emits a light beam 64 (shown in FIG. 4). The light beam 64 enters the optical transmitting element 204 through the receiving end 401, leaves the optical transmitting element 204 through the emitting end 403 and is received by an eye of the user adjacent to the eyepiece unit 16 so that the user can observe illumination of the emitting end 403. By contrast, when the sight fails to be connected to the electronic device 100, the control unit 21 is activated to switch the conducting loop to a cut-off state. Meanwhile, the electric current does not flow through the illuminating element 206, the illuminating element 206 does not emit the light beam 64, and the user cannot observe the illumination of the emitting end 403. In brief, the user can know if the connection of the sight 10 to the electronic device 100 is successful through recognizing the state of the emitting end 403 of the indicating structure 20 (i.e. illuminating or extinguished).

In present embodiment, the illuminating element 206 is light emitting diode (LED), and the optical transmitting element 204 is optical fiber. It is understood that the illuminating element 206 can be colored (e.g. red, green or blue) light emitting diode so that the user can observe colored light illuminated by the emitting end 403, and the optical transmitting element 204 can be transparent optical fiber. In another embodiment, the illuminating element 206 can be a white light emitting diode, and the optical transmitting element 204 can be a colored optical fiber.

To adjust magnification of the sight 10, the adjusting ring 18 is rotated for moving at least one lens 131 of the inner lens barrel 13 in the direction parallel to the optical axis. As the adjusting ring 18 is rotated, the indicating structure 20 is moved with respect to the main body 12 in the circumferential direction of the main body 12. Since the conductive elements 22 are curved and substantially extend in the circumferential direction of the main body 12, the leg members 283 are kept against the conductive elements 22 during the movement of the indicating structure 20. In other words, after the sight 10 is successfully connected to the electronic device 100, the user can still observe the illumination of the emitting end 403 from the outside of the sight 10, even if the adjusting ring 18 and the indicating structure 20 are rotated with respect to the main body 12. If a magnification scale (not shown) is additionally provided disposed on an outer surface of the main body 12 for user's observation, then the emitting end 403, when illuminating, can act as an indicating light for indicating the present magnification of the sight 10.

As shown in FIG. 4, it is noting that the receiving end 401 includes a plane 4011 (or a light penetrable area) perpendicular to the optical axis or the central axis of the main body 12, and the light beam 64 emitted by the illuminating element 206 enters the optical transmitting element 204 through the plane 4011 (or the light penetrable area). Moreover, in another embodiment, the receiving end 401 includes a plane (not shown) sloping at an angle with respect to the optical axis, and the angle is substantially 45 degrees.

In another embodiment, the illuminating element 206 is a bi-color light emitting diode, and the control unit 21 is configured to control the conducting loop for switching the light beam 64 emitted by the illuminating element 206 between different colors to indicate the connection status of the sight 10 and the electronic device 100 to the user. For example, when the user observes red light illuminated by the emitting end 403, it indicates that the sight 10 is not connected to the electronic device 100. When the user observes green light illuminated by the emitting end 403, it indicates that the sight 10 is connected to the electronic device 100. In such arrangement, the indicating structure 20 can act as an indicating light which indicates the present magnification of the sight 10, even if the sight 10 fails to be connected to the electronic device 100. The arrangement of other elements and operation are similar to those of the above embodiment, and therefore the descriptions thereof are omitted.

In yet another embodiment, the control unit 21 is configured to control the conducting loop for adjusting the frequency at which the illuminating element 206 emits the light beam 64 to indicate the connection status of the sight 10 and the electronic device 100 to the user. For example, when the emitting end 403 flickers because of the described adjustment of the frequency, it indicates that the sight 10 is not connected to the electronic device 100. On the other hand, when the emitting end 403 does not flicker, it indicates that the sight 10 is connected to the electronic device 100. In such arrangement, the indicating structure 20 can act as an indicating light which indicates the present magnification of the sight 10, even if the sight 10 fails to be connected to the electronic device 100. The arrangement of other elements and operation are similar to those of the above embodiment, and therefore the descriptions thereof are omitted.

In sum, the indicating structure 20 disposed on the adjusting ring 18 is capable of indicating the connection status of the sight 10 and the electronic device 100 to the user. Moreover, the indicating structure 20 can also act as an indicating light which indicates the present magnification of the sight 10.

What is claimed is:

1. A sight, comprising:

a main body having a first end portion and a second end portion;

an objective unit connected to the first end portion;

an eyepiece unit connected to the second end portion;

an inner lens barrel disposed in the main body and between the objective unit and the eyepiece unit and comprising a plurality of lenses, wherein the objective unit, the inner lens barrel and the eyepiece unit are sequentially arranged to form an optical axis;

an adjusting ring rotatably disposed on the main body; and an indicating structure disposed on the adjusting ring and comprising an illuminating element and an optical transmitting element, wherein when the adjusting ring is rotated, the indicating structure is moved with respect to the main body;

wherein when the sight is connected to an electronic device, the illuminating element emits a light beam, and the light beam passes through the optical transmitting element for generating an indicating sign.

2. The sight as claimed in claim 1, wherein the main body further has two conductive elements, the illuminating element has two pins, and the conductive elements are respectively connected to the pins of the illuminating element.

3. The sight as claimed in claim 2, wherein the adjusting ring covers the conductive elements.

4. The sight as claimed in claim 3, wherein the indicating structure further comprises a circuit board and two leg members, the illuminating element and the leg members are disposed on the circuit board so that the leg members are respectively connected to the pins of the illuminating element.

5. The sight as claimed in claim 4, wherein the leg members respectively extend from the circuit board, through the adjusting ring and against the conductive elements.

6. The sight as claimed in claim 5, further comprising a power supply disposed in the main body and configured to provide electric current for the illuminating element through the conductive elements, the leg members and the circuit board so that the illuminating element emits the light beam.

7. The sight as claimed in claim 6, further comprising:

a control unit disposed in the main body, wherein when the sight is connected to the electronic device, the control unit is configured to control the electric current to flow through the illuminating element; and an aiming symbol disposed between the objective unit and the inner lens barrel or disposed between the inner lens barrel and the eyepiece unit.

8. The sight as claimed in claim 2, wherein the conductive elements are curved to substantially extend in a circumferential direction of the main body.

9. The sight as claimed in claim 1, further comprising a communication unit disposed in the main body, wherein the sight is wirelessly connected to the electronic device through the communication unit.

10. The sight as claimed in claim 1, wherein the optical transmitting element has a receiving end configured to receive the light beam, and the receiving end comprises a plane sloping at an angle with respect to the optical axis.

11. The sight as claimed in claim 10, wherein the angle is substantially 45 degrees.

12. The sight as claimed in claim 1, wherein the optical transmitting element has a receiving end, and the receiving end comprises a light penetrable area configured to receive the light beam.

13. A sight, comprising:

a main body having a first end portion and a second end portion;

an objective unit connected to the first end portion;

an eyepiece unit connected to the second end portion;

an adjusting ring rotatably disposed on the main body; and an indicating structure disposed on the adjusting ring and comprising a bi-color illuminating element and an optical transmitting element;

wherein when the sight is connected to an electronic device, the illuminating element emits a first light beam, and the first light beam passes through the optical transmitting element for generating a first indicating sign;

wherein when the sight is not connected to the electronic device, the illuminating element emits a second light beam, and the second light beam passes through the optical transmitting element for generating a second indicating sign;

wherein the objective unit and the eyepiece unit are sequentially arranged to form an optical axis;

wherein the main body further has a conductive unit connected to the illuminating element.

14. The sight as claimed in claim 13, wherein the conductive unit has two conductive elements, the illuminating element has two pins, and the conductive elements are respectively connected to the pins of the illuminating element.

15. The sight as claimed in claim 14, wherein the adjusting ring covers the conductive elements.

16. The sight as claimed in claim 15, wherein the indicating structure further comprises a circuit board and two leg members, the illuminating element and the leg members are disposed on the circuit board so that the leg members are respectively connected to the pins of the illuminating element, and the leg members respectively extend from the circuit board, through the adjusting ring and against the conductive elements.

17. The sight as claimed in claim 14, wherein the conductive elements are curved to substantially extend in a circumferential direction of the main body.

18. The sight as claimed in claim 13, further comprising a communication unit disposed in the main body, wherein the sight is wirelessly connected to the electronic device through the communication unit.

19. The sight as claimed in claim 13, wherein the optical transmitting element has a receiving end configured to receive the light beam, and the receiving end comprises a plane sloping at an angle with respect to the optical axis.

20. The sight as claimed in claim 19, wherein the angle is substantially 45 degrees.

* * * * *